US008678844B2

(12) United States Patent
Yoshisuji et al.

(10) Patent No.: US 8,678,844 B2
(45) Date of Patent: Mar. 25, 2014

(54) ELECTRICAL CONNECTOR WITH ONE ACTION AUTOMATIC MECHANISM

(75) Inventors: Takashi Yoshisuji, Machida (JP); Yoshinobu Shimada, Machida (JP)

(73) Assignee: Dai-Ichi Seiko Co., Ltd., Kyoto-shi (JP)

( * ) Notice: Subject to any disclaimer, the term of this patent is extended or adjusted under 35 U.S.C. 154(b) by 84 days.

(21) Appl. No.: 13/416,212

(22) Filed: Mar. 9, 2012

(65) Prior Publication Data

US 2012/0238125 A1 Sep. 20, 2012

(30) Foreign Application Priority Data

Mar. 18, 2011 (JP) ..... 2011-060182
Feb. 22, 2012 (JP) ..... 2012-036539

(51) Int. Cl.
*H01R 13/627* (2006.01)

(52) U.S. Cl.
USPC ..... 439/350; 439/260; 439/495

(58) Field of Classification Search
USPC ..... 439/350, 260, 495
See application file for complete search history.

(56) References Cited

U.S. PATENT DOCUMENTS 7,094,093 B2 * 8/2006 Nakano et al. ..... 439/495
7,416,438 B2 * 8/2008 Hashiguchi et al. ..... 439/495
7,766,680 B2 * 8/2010 Suzuki et al. ..... 439/260
8,123,550 B2 * 2/2012 Hoshino et al. ..... 439/495
8,371,880 B2 * 2/2013 Ishimaru ..... 439/632
2006/0105622 A1 * 5/2006 Nakano et al. ..... 439/495
2012/0214329 A1 * 8/2012 Ishimaru ..... 439/350

FOREIGN PATENT DOCUMENTS

JP 2008-52993 3/2008

OTHER PUBLICATIONS

U.S. Appl. No. 29/402,240, filed Sep. 22, 2011, Yoshisuji.
U.S. Appl. No. 29/402,237, filed Sep. 22, 2011, Yoshisuji.
U.S. Appl. No. 29/402,872, filed Sep. 28, 2011, Yoshisuji.
U.S. Appl. No. 13/595,147, filed Aug. 27, 2012, Yoshisuji, et al.
U.S. Appl. No. 29/447,042, filed Feb. 28, 2013, Yoshisuji.
U.S. Appl. No. 29/457,234, filed Jun. 7, 2013, Yoshisuji.
U.S. Appl. No. 29/457,252, filed Jun. 7, 2013, Yoshisuji.
U.S. Appl. No. 29/454,279, filed May 8, 2013, Yoshisuji.
U.S. Appl. No. 29/454,268, filed May 8, 2013, Yoshisuji.

* cited by examiner

*Primary Examiner* — Hae Moon Hyeon
(74) *Attorney, Agent, or Firm* — Oblon, Spivak, McClelland, Maier & Neustadt, L.L.P.

(57) ABSTRACT

To allow a quick and reliable check with a simple structure as to whether a signal transmission medium has been inserted up to a predetermined position or whether a lock operation has been completed, an insulating housing is provided with lock checking device allowing a displaced state or an engaged state of a lock member to be visually checked. With this, the displaced state of the lock member or a state in which the signal transmission medium has fallen in an engagement positioning part when the signal transmission medium is inserted up to the predetermined position can be visually checked through the lock checking device, thereby allowing the quality of an insertion state of the signal transmission medium to be immediately determined.

6 Claims, 15 Drawing Sheets

ELECTRICAL CONNECTOR WITH ONE ACTION AUTOMATIC MECHANISM

BACKGROUND OF THE INVENTION

1. Field of the Invention

The present invention relates to an electric connector configured so as to hold a signal transmission medium by an elastic force of a lock member with a terminal portion of the signal transmission medium being inserted in an insulating housing up to a predetermined position therein.

2. Description of the Related Art

In general, in various electric apparatuses and others, various electric connectors are widely used as device for electrically connecting various signal transmission media such as a flexible printed circuit (FPC) and a flexible flat cable (FFC). For example, in an electric connector for use as being mounted on a printed wiring board as described in Japanese Unexamined Patent Application Publication No. 2008-52993, a signal transmission medium formed of an FPC, an FFC, or the like is inserted into the inside of an insulating housing (an insulator) from its opening on a front end side, and then an actuator (connecting operation device) is rotated so as to be pushed down toward a connecting action position on a front side or a rear side of the connector by an operating force of an operator. With this, a part of a lock member falls in an engaging part provided in a terminal portion of the signal transmission medium to become in an engaged state, and the terminal portion of the signal transmission medium is held by the lock member in an approximately unmovable state.

As such, the electric connector including the actuator is configured to operate engagement and disengagement of the lock member by rotating the actuator between a connection release position and a connection acting position. Apart from a work of inserting the signal transmission medium (such as FPC or FFC), operating the actuator is required, thereby possibly posing a problem of work efficiency. For this reason, conventionally in some cases, an electric connector including a so-called one-action automatic lock mechanism may be adopted, the mechanism being configured so that a part of the lock member is elastically displaced so as to override the signal transmission medium inserted in the inside of the insulating housing and then the part of the lock member falls in the engaging part of the signal transmission medium for engagement. With the use of the electric connector including this one-action automatic lock mechanism, the signal transmission medium is held in an approximately unmovable state only by inserting the signal transmission medium in the electric connector up to the predetermined position therein, thereby achieving an improvement in work efficiency.

However, in the one-action automatic lock mechanism adopted in the conventional electric connector while there is an advantage of locking only with the signal transmission medium (such as FPC or FFC) being inserted in the electric connector, as described above, there is a problem such that it cannot be immediately checked or determined whether the signal transmission medium has been correctly inserted up to the predetermined position, whether the lock operation has been completed, or others, possibly requiring time and effort to finally check the completion of the work of connecting the signal transmission medium.

SUMMARY OF THE INVENTION

Therefore, an object of the present invention is to provide an electric connector allowing an insertion state of a signal transmission medium formed of an FPC, an FFC, or the like to be immediately checked with a simple structure.

To achieve the above-described object, in the present invention, in an electric connector configured so that a lock member holding, in an approximately unmovable state, a terminal portion of a signal transmission medium inserted in an insulating housing up to a predetermined position therein so that the terminal portion is in an approximately unmovable state is provided inside the insulating housing and, after a part of the lock member is elastically displaced so as to override the surface of the signal transmission medium with the insertion of the signal transmission medium, the part of the lock member falls in an engagement positioning part provided at the terminal portion of the signal transmission medium to become in an engaged state, a structure is adopted in which the insulating housing is provided with lock checking device allowing a displaced state or an engaged state of the lock member to be visually checked.

According to the present invention with the above-described structure, when the signal transmission medium is inserted up to the predetermined position, the displaced state of the lock member or the state of the signal transmission medium falling in the engagement positioning part of the signal transmission medium is visually checked through the lock checking device, thereby allowing the quality of the insertion state of the signal transmission medium to be immediately determined.

Also, the lock checking device can in the present invention be configured of window part or a slit part provided so as to penetrate through a wall surface configuring the insulating housing.

Furthermore, the slit part as the lock checking device in the present invention is preferably configured so that the part of the lock member protrudes through the slit part toward outside of the insulating housing when the lock member is elastically displaced.

According to the present invention with the above-described structure, the lock member protrudes outward from the slit part when the signal transmission medium is inserted by a necessary amount, a good insertion state of the signal transmission medium can be easily recognized by an operator.

Furthermore, the window part as the lock checking device in the present invention can be provided so as to face a position inside the insulating housing before or after displacement or before or after engagement of the lock member.

Still further, preferably in the present invention, the lock member is provided with a release pressing part to which an operating forces is added in a direction of elastically displacing the lock member, and the insulating housing is provided with an operation cover part extending so as to overlap a release pressing part of the lock member.

According to the present invention with the above-described structure, the operation of releasing the engaged state of the lock member with respect to the signal transmission medium is easily and reliably performed by an operation on the operation cover part provided to the insulating housing.

Still further, preferably in the present invention, the operation cover parts are disposed in a pair so as to be appropriately spaced apart from each other, and an operation arm part is provided to extend so as to integrally couple the paired operation cover parts together.

According to the present invention with the above-described structure, an operation of releasing an engaged state of lock members provided in a pair is simultaneously and efficiently performed by an operation on the operation arm part.

Still further, preferably in the present invention, the operation arm part is provided with inclined parts so that a height in a pressing direction is successively decreased from portions on both end sides to a center portion of the operation arm part in a longitudinal direction.

According to the present invention with the above-described structure, when the operation arm part is operated, fingertips of the operator are difficult to hook over the inclined surface parts provided on both end sides of the operation arm part, and an operating force is added mainly to the center portion of the operation arm part, thereby making it possible to prevent damage on the operation arm part and others.

Still further, preferably in the present invention, the lock operation cover part is configured that the lock operation cover parts sandwiches the lock release pressing part from the forward and backward in the direction in which an operating down force is added so as to make the lock member displace elastically.

According to the present invention with the above-described structure, because of the structure in which the lock operation cover parts has the lower cover supporting portion and the entire part of the lock member and the lock operation cover parts is supported elastically with the paired elastic cover arms, for example, even when plastic deformation is caused in the lock member by such as adding the lock releasing operation force, elastic holding force by the elastic cover arms acts on the lock member from the downward side so as to hold the lock member via the lower cover supporting portion. This elastic holding force by the elastic cover arms makes possible for the lock member to come back to the original position so as to result in that a normal lock action is maintained steadily.

As described above, the electric connector according to the present invention is configured so that the lock checking device allowing a displaced state or an engaged state of the lock member to be visually checked is provided to the insulating housing to allow a visual check, through the lock checking device, of the displaced state of the lock member or the state of the signal transmission medium falling in the engagement positioning part when the signal transmission medium is inserted up to the predetermined position, thereby allowing the quality of the insertion state of the signal transmission medium to be immediately determined. Thus, whether the signal transmission medium has been inserted up to the predetermined position or whether the lock state has been completed can be quickly and reliably checked with a simple structure, and reliability of the electric connector can be significantly improved at low cost.

DETAILED DESCRIPTION OF THE PREFERRED EMBODIMENTS

Figure 1:
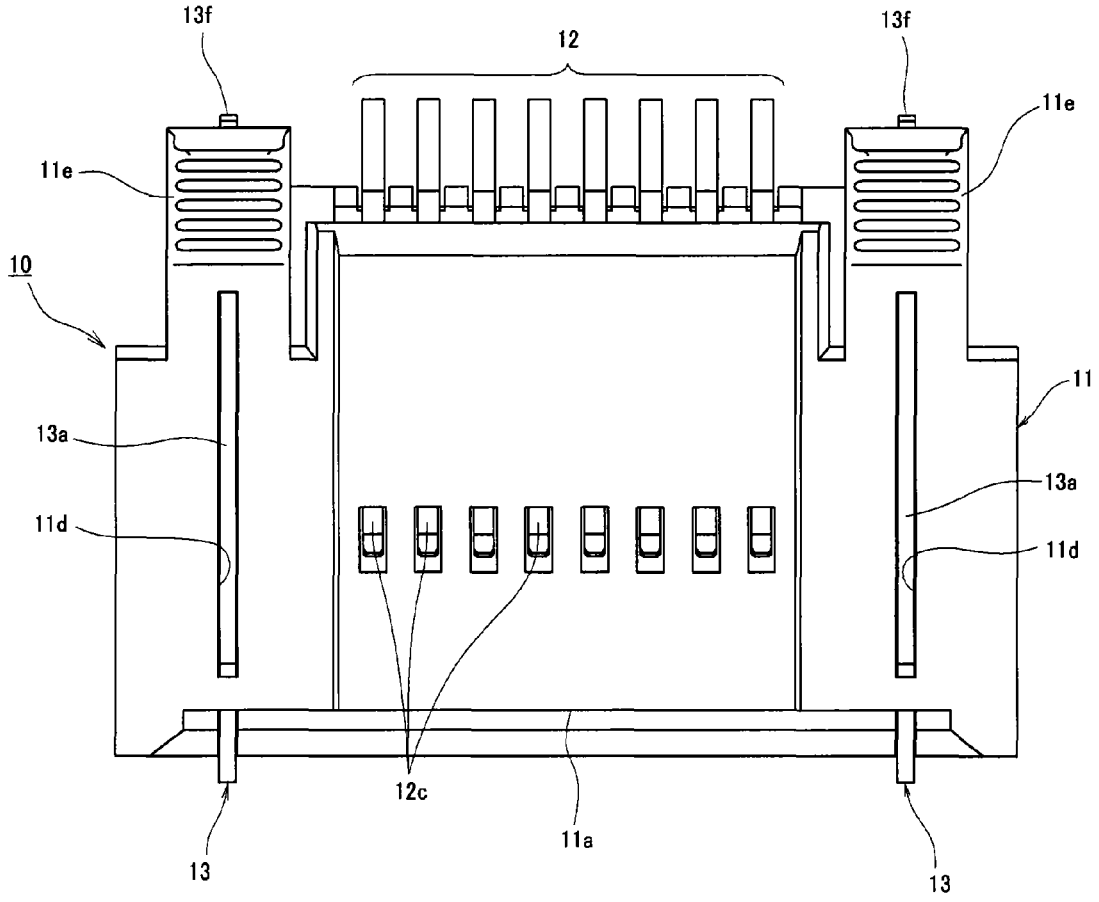
FIG. 1 is a descriptive plan view of an electric connector according to a first embodiment of the present invention.
Figure 2:
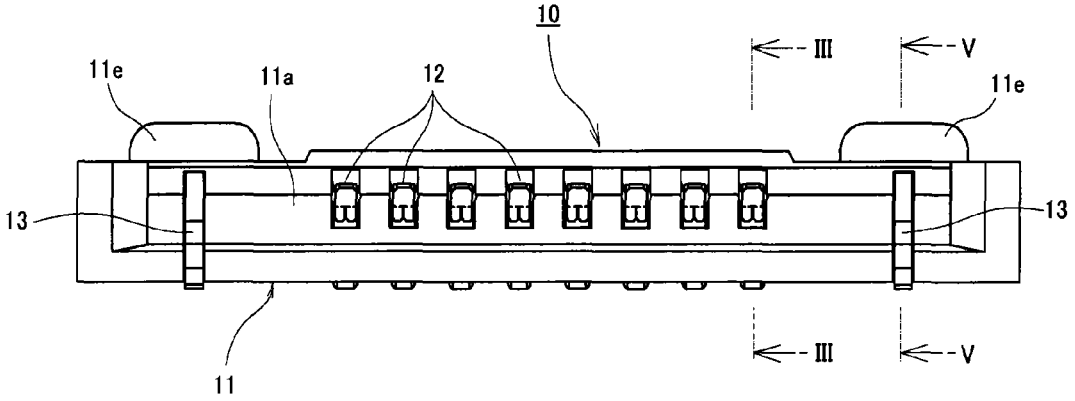
FIG. 2 is a descriptive front view of the electric connector depicted in FIG. 1.

Embodiments are described in detail below based on the drawings, in which the present invention is applied to an electric connector for use as being mounted on a wiring board for connecting a signal transmission medium formed of a flexible printed circuit (FPC), a flexible flat cable (FFC), or the like.

Regarding Entire Structure of Electric Connector According to First Embodiment First, an electric connector 10 according to a first embodiment of the present invention depicted in FIG. 1 to FIG. 8 is formed of an electric connector including a one-action automatic lock mechanism of a so-called NON-ZIF type, and is configured so that, when a terminal portion of a signal transmission medium (such as FPC or FFC) F described above is inserted, through a medium insertion opening 11*a* provided at a front end edge part (a left end edge part in FIG. 3) of an insulating housing 11, in the insulating housing 11 up to a predetermined position therein, the signal transmission medium F is automatically locked.

[Regarding Insulating Housing]

Here, while the insulating housing 11 is formed of a hollow-frame-shaped insulating member extending in an elongated shape, a longitudinal breadth direction of the insulating housing 11 is hereinafter referred to as a connector longitudinal direction, and a direction in which the terminal portion of the signal transmission medium (such as FPC or FFC) F is inserted or disengaged is hereinafter referred to as a connector front-back direction.

At a front end edge portion (a left end edge portion in FIG. 3) of the insulating housing 11, the medium insertion opening 11*a* through which the terminal portion of the signal transmission medium F formed of a flexible printed circuit (FPC), a flexible flat cable (FFC), or the like is inserted is provided so as to form an elongated shape along the connector longitudinal direction. At both end portions of the medium insertion opening 11*a* in the connector longitudinal direction, lock members 13, which will be described further below, are inserted toward a rear side (a right side in FIG. 5). Also, at a rear end edge portion (a right end edge portion in FIG. 3) on an opposite side of the medium insertion opening 11*a* in the connector front-back direction, a component mount opening 11*b* for mounting conductive contacts 12 and others is provided so as to form an elongated shape also along the connector longitudinal direction.

[Regarding Conductive Contacts]

The conductive contacts 12 are formed of a thin-plate metal-made member having an appropriate shape. The plurality of these conductive contacts 12 are inserted from the component mount opening 11*b* of the insulating housing 11 on a rear end side toward a front side (a left side in FIG. 3). Inside the insulating housing 11, the conductive contacts 12 are disposed in a multi-contact manner so as to be appropriately spaced apart from each other in the connector longitudinal direction. These conductive contacts 12 are each used as either a contact for signal transmission or a contact for ground connection as being mounted by solder joint on a conductive path formed on a main printed wiring board (not shown).

That is, the conductive contacts 12 mounted in the inside of the insulating housing 11 in the above-described manner are disposed at positions that are set correspondingly to a wiring pattern provided on the signal transmission medium (such as FPC or FFC) F to be inserted in the insulating housing 11 through the medium insertion opening 11*a*. The wiring pattern of the signal transmission medium F is formed by disposing conductive paths for signal transmission (signal line pads) or conductive paths for shielding (shield line pads) with appropriate pitch spaces.

The structure of each conductive contact 12 is specifically described. The conductive contact 12 is formed so as to extend along the front-back direction, which is an insertion/removal direction of the signal transmission medium F (a lateral direction in FIG. 3). A portion on a connector rear end side, that is, a portion protruding rearward from the connector rear end part of the insulating housing 11, is formed as a board connecting part 12*a* connected by soldering to the conductive path formed on the main printed wiring board (not shown). The board connecting part 12*a* is contiguously connected to a flexible arm part 12*b* formed of an elongated beam member extending from the board connecting part 12*a* toward a front side. In the flexible arm part 12*b*, a portion contiguously connected to the board connecting part 12*a* described above is formed as being bent so as to rise at an approximately right angle, and also a rising end portion is bent again at an approximately right angle toward the front side, extending in a cantilever shape along an inner wall surface of a ceiling plate of the insulating housing 11 on an upper side in the drawings.

Figure 3:
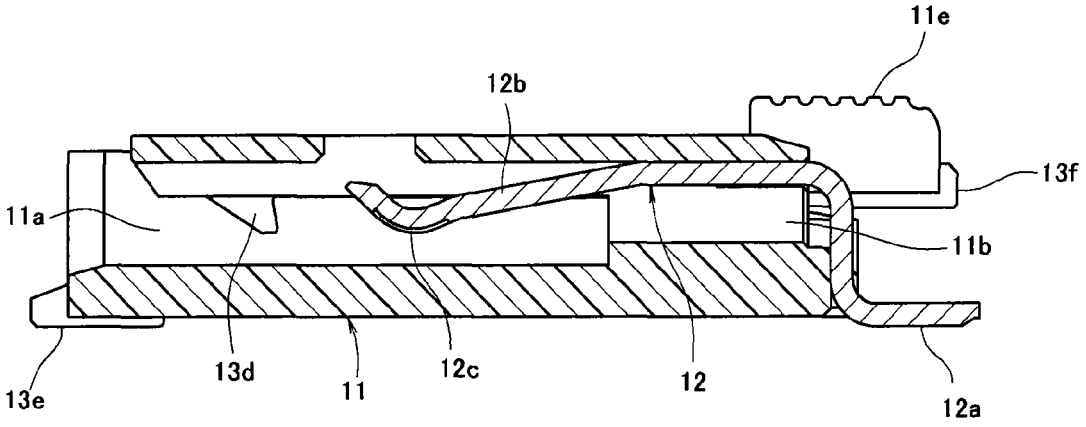
FIG. 3 is a descriptive cross-sectional view along the III-III line in FIG. 2.

The flexible arm part 12*b* provided to the conductive contact 12 in this manner is configured to swing in a vertical direction on paper in FIG. 3, taking the portion contiguously connected to the board connecting part 12*a* or nearby as a center. The extended portion of the flexible beam part 12*b* on the front end side (the portion on the left end side in FIG. 3) is provided with a terminal contact convex part 12*c* corresponding to either a conductive path for signal transmission or a conductive path for shielding (wiring pattern) formed on the signal transmission medium (such as FPC or FFC) F, the part 12*c* forming a shape protruding downward in the drawings. That is, this terminal contact convex part 12*c* provided to the conductive contact 12 is disposed so as to override the wiring pattern of the signal transmission medium F when the signal transmission medium F is inserted in the inside of the insulating housing 11 as described above. When the signal transmission medium F is inserted up to a predetermined final position, the terminal contact convex part 12*c* and the signal transmission medium F are both press-contacted each other by an elastic force of the flexible beam part 12*b* to be kept in an electrically connected state.

[Regarding One-Action Automatic Lock Mechanism]

Figure 4:
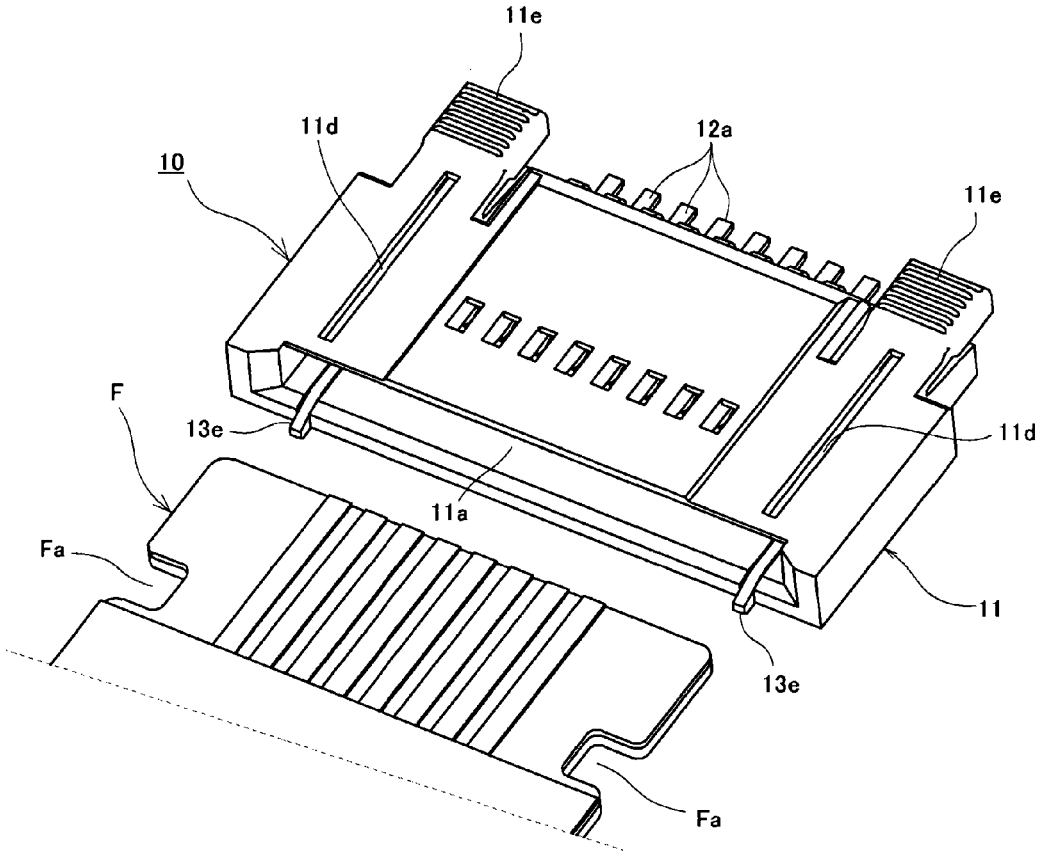
FIG. 4 is a descriptive external perspective view of a state immediately before a signal transmission medium is inserted in the electric connector depicted in FIG. 1 to FIG. 3.

The electric connector 10 according to the present embodiment, includes a one-action automatic lock mechanism as described above. It is premised that, at a terminal portion of the signal transmission medium (such as FPC or FFC) F, particularly as depicted in FIG. 4, engagement positioning parts Fa each formed of a notched concave part are formed at end edge portions on both sides in a width direction. Correspondingly to the engagement positioning parts Fa provided on the signal transmission medium F, lock members 13 are provided on an electric connector 10 side. With an engaging action (a lock action) of these lock members 13, the insertion state of the signal transmission medium F is kept.

[Regarding Lock Members]

The lock members 13 described above are disposed at both end portions of the insulating housing 11 in the connector longitudinal direction. When the signal transmission medium (such as FPC or FFC) F is inserted in the inside of the electric connector 10, a part of each lock member 13, more specifically, an engagement lock part 13*d*, which will be described further below, overrides the surface of the signal transmission medium F, thereby causing the lock members 13 to become in an elastically-displaced state. Furthermore, the engagement lock part 13*d*, which is a part of the lock member 13, falls in the engagement positioning part Fa of the signal transmission medium F to become in an engaged state (a lock state).

Here, the lock member 13 has a movable beam part 13*a* and a fixed beam part 13*b* formed of paired elongated beam members. These movable beam part 13*a* and the fixed beam part 13*b* are disposed so as to face each other as being appropriately spaced apart from each other in an inner space of the above-described insulating housing 11 in a vertical direction in the drawings. Of these, the fixed beam part 13*b* is fixed to be in an approximately unmovable state along an inner wall surface of a bottom plate of the insulating housing 11, and the movable beam part 13*a* extending approximately in parallel to and at an upper position in the drawing of the fixed beam part 13*b* is integrally coupled to the fixed beam part 13*b* via a coupling support part 13*c*.

The coupling support part 13*c* is formed of a plate-shaped member having a narrow width. In a portion on a rear side in a direction in which both of the beams 13*a* and 13*b* extend, the coupling support part 13*c* is disposed, having a side surface in an approximately right angle bracket (>) shape and extending in the vertical direction in the drawings. The movable beam part 13*a* coupled to an upper end portion in the drawings of the coupling support part 13*c* can be elastically displaced with respect to the fixed beam part 13*b* based on elastic flexibility of the coupling support part 13*c*. The movable beam part 13*a* is configured to be able to swing by taking the coupling support part 13*c* or nearby as a rotation center. Here, the swinging of the movable beam part 13*a* is performed in a vertical direction on paper in FIG. 5.

Also, a portion of the movable beam part 13*a* configured as a swinging member as described above on a front end side (on a portion on a left end side in FIG. 5) is provided with an engagement lock member 13*d* formed of a hook-shaped member. The engagement lock member 13*d* is formed of a plate-shaped member protruding downward to form an approximately triangular shape, the member being provided with a vertex part on a lower end side of the engagement lock part 13*d* and an inclined guide side obliquely extending upward on a front side from the lower-end-side vertex part. The engagement lock part 13*d* having the structure described above falls toward the inside of the engagement positioning part Fa when disposed at a position straight above the engagement positioning part. Fa provided at the terminal portion of the signal transmission medium F described above to become in an engaged state. With an engaging force of the engagement lock part 13*d* at that time, the insertion state of the signal transmission medium F is kept.

Figure 5:
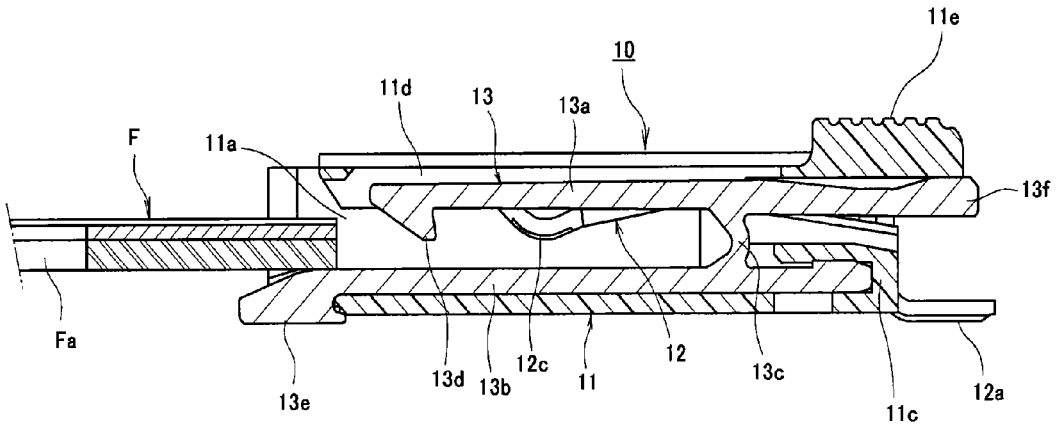
FIG. 5 is a descriptive cross-sectional view corresponding to a V-V line in FIG. 2, depicting the state in which the signal transmission medium is partially inserted, the state being changed from the state depicted in FIG. 4.
Figure 6:
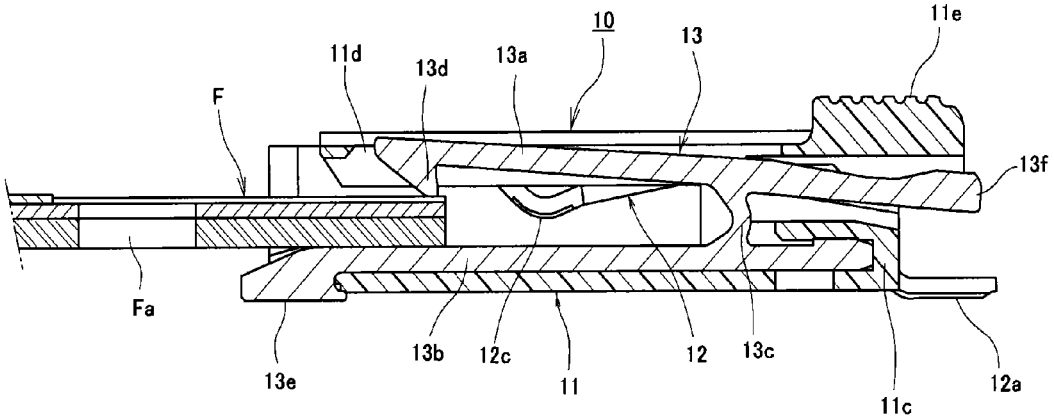
FIG. 6 is a descriptive cross-sectional view corresponding to the V-V line in FIG. 2, depicting the state in which the signal transmission medium is further inserted, the state being changed from the state depicted in FIG. 5.
Figure 7:
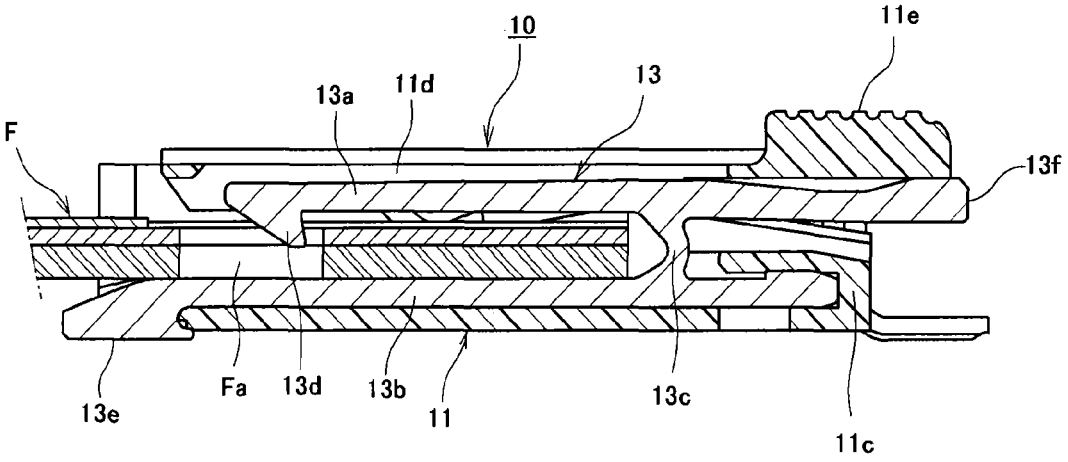
FIG. 7 is a descriptive cross-sectional view corresponding to the V-V line in FIG. 2, depicting the state in which the signal transmission medium is further inserted and thus insertion of the signal transmission medium in the electric connector is completed, with the signal transmission medium being engaged by an engagement locking part, the state changed from the state depicted in FIG. 6.

The state from insertion to engagement of the signal transmission medium (such as FPC or FFC) F is specifically described. First, as depicted in FIG. 4 and FIG. 5, when the signal transmission medium F is inserted in the inside of the insulating housing 11 through the medium insertion opening 11*a* of the insulating housing 11, a tip edge part of the signal transmission medium F on an insertion side abuts on the inclined guide side of the engagement lock part 13*d* provided on each lock member 13, thereby causing the engagement lock part 13*d* to override the surface of the signal transmission medium F. With this, the movable beam part 13*a* of each lock member 13 described above is elastically displaced so as to be pushed up to an upper side with a swing fulcrum near the coupling support part 13*c* as a center, as depicted in FIG. 6. Furthermore, with the terminal portion of the signal transmission medium F being pushed toward a rear side, when the engagement positioning parts Fa of the signal transmission medium F each move up to a position straight below the engagement lock part 13*d*, the engagement lock part 13*d* is swung so as to fall in the engagement positioning part Fa of the signal transmission medium F by elastic resilience of the movable beam part 13*a*, as depicted in FIG. 7. As a result, the engagement lock part 13*d* becomes in an engaged state with respect to the engagement positioning part Fa of the signal transmission medium F, and the signal transmission medium F is held so as not to come off.

On the other hand, while the fixing beam part 13*b* of each lock member 13 is disposed so as to extend in the front-back direction along an inner wall surface of the bottom plate of the insulating housing 11, a tip portion of the fixed beam part 13*b* on a rear side (a right-side portion in FIG. 5) is press-fitted in a lock fixing member 11*c* provided in the insulating housing 11 to be kept in a fixed state. Also, a tip portion of the fixed beam part 13*b* on a front side (a left-side portion in FIG. 5) is formed as a board connecting part 13*e* connected by soldering to the conductive path formed on the main printed wiring board (not shown).

When the signal transmission medium (such as FPC or FFC) F is brought into an engaged state (a lock state) by the lock members 13, the front-side portion of each movable beam part 13*a* including the engagement lock part 13*d* described above is elastically displaced so as to be pushed upward. Elastic displacement of the movable beam part 13*a* to the upper side at that time is allowed by a slit part 11*d* provided in the insulating housing 11 as lock checking device. This slit part 11*d* configuring the lock checking device is formed of an elongated hole part penetrating through a ceiling wall part of the insulating housing 11, has a length of the upper-side portion of the movable beam part 13*a* described above that covers portions corresponding to the coupling support part 13*c* to the engagement lock part 13*d*, and is formed of an elongated space portion having a gap slightly larger than a plate thickness of the movable beam part 13*a*.

When the signal transmission medium (such as FPC or FFC) F is inserted in the inside of the insulating housing 11 as described above, the engaging lock part 13*d* of each lock member 13 overrides the surface of the signal transmission medium F to cause the movable beam part 13*a* of the lock member 13 to be elastically displaced so as to be pushed up to the upper side. With this, the front-side portion of the movable beam part 13*a* elastically displaced upward enters the inside of the slit part 11*d* as the lock checking device described above, thereby allowing upward elastic displacement of the movable beam part 13*a* and also visually checking upward elastic displacement of the movable beam part 13*a*.

That is, the front-end portion of the movable beam part 13*a* including the engagement lock part 13*d* described above is disposed so as to has a relation in which the front-end portion passes through the slit part 11*d* as the lock checking device to protrude upward at the time of upward elastic displacement. In the course of a process of inserting the signal transmission medium (such as FPC or FFC) F in the inside of the insulating housing 11, the front-end portion of each movable beam part 13*a* configuring the lock member 13 is configured to protrude through the slit part (lock checking device) 11*d* to further protrude to an upper side from the upper surface of the insulating housing 11. The upper-side protruding portion of each movable beam part 13*a* is visually checked from outside by an operator or others, thereby easily checking the displaced state of the lock member 13.

Then, the engagement positioning parts Fa of the signal transmission medium (such as FPC or FFC) F each move up to a position straight below the engagement lock part 13*d*. When the engagement lock part 13*d* falls in the engagement positioning part Fa of the signal transmission medium F, the front-end portion of the movable beam part 13*a* that has been protruding so far from the upper surface of the insulating housing 11 to an upper side again sinks in the insulating housing 11 through the slit part 11*d*, thereby not being allowed to be visually checked from outside.

[Regarding Lock Releasing Mechanism]

Figure 8:
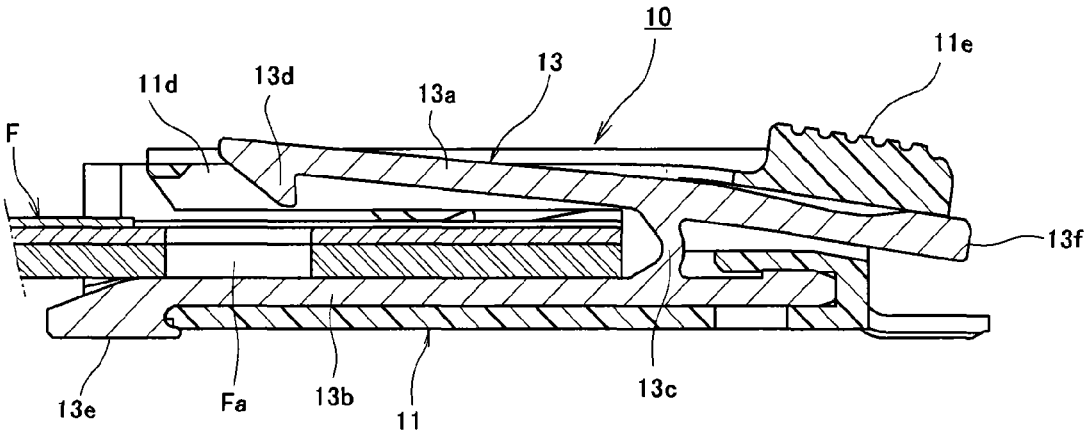
FIG. 8 is a descriptive cross-sectional view corresponding to the V-V line in FIG. 2, depicting the state in which a releasing operation is performed to push the lock member up, the state changed from a lock state depicted in FIG. 7.
Figure 9:
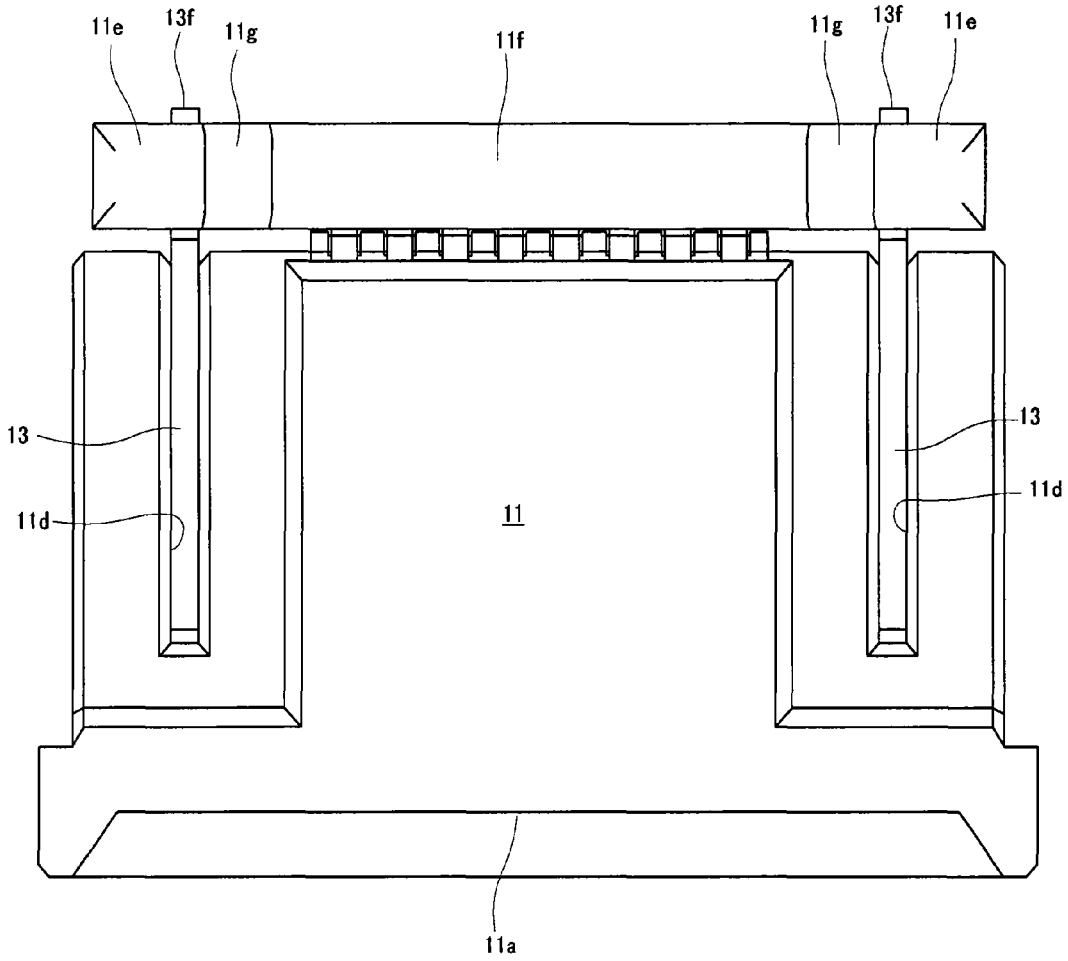
FIG. 9 is a descriptive plan view of an electric connector according to a second embodiment of the present invention.
Figure 10:
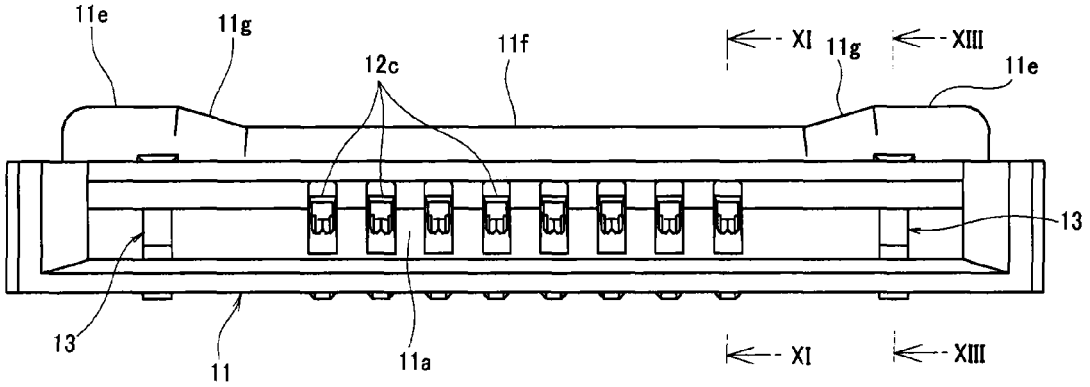
FIG. 10 is a descriptive front view of the electric connector depicted in FIG. 9.
Figure 11:
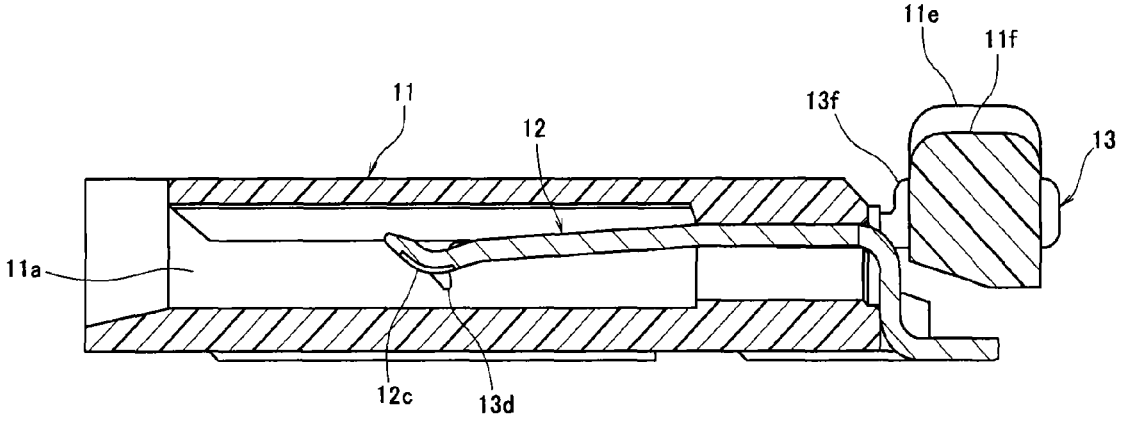
FIG. 11 is a descriptive cross-sectional view along a XI-XI line in FIG. 10.
Figure 12:
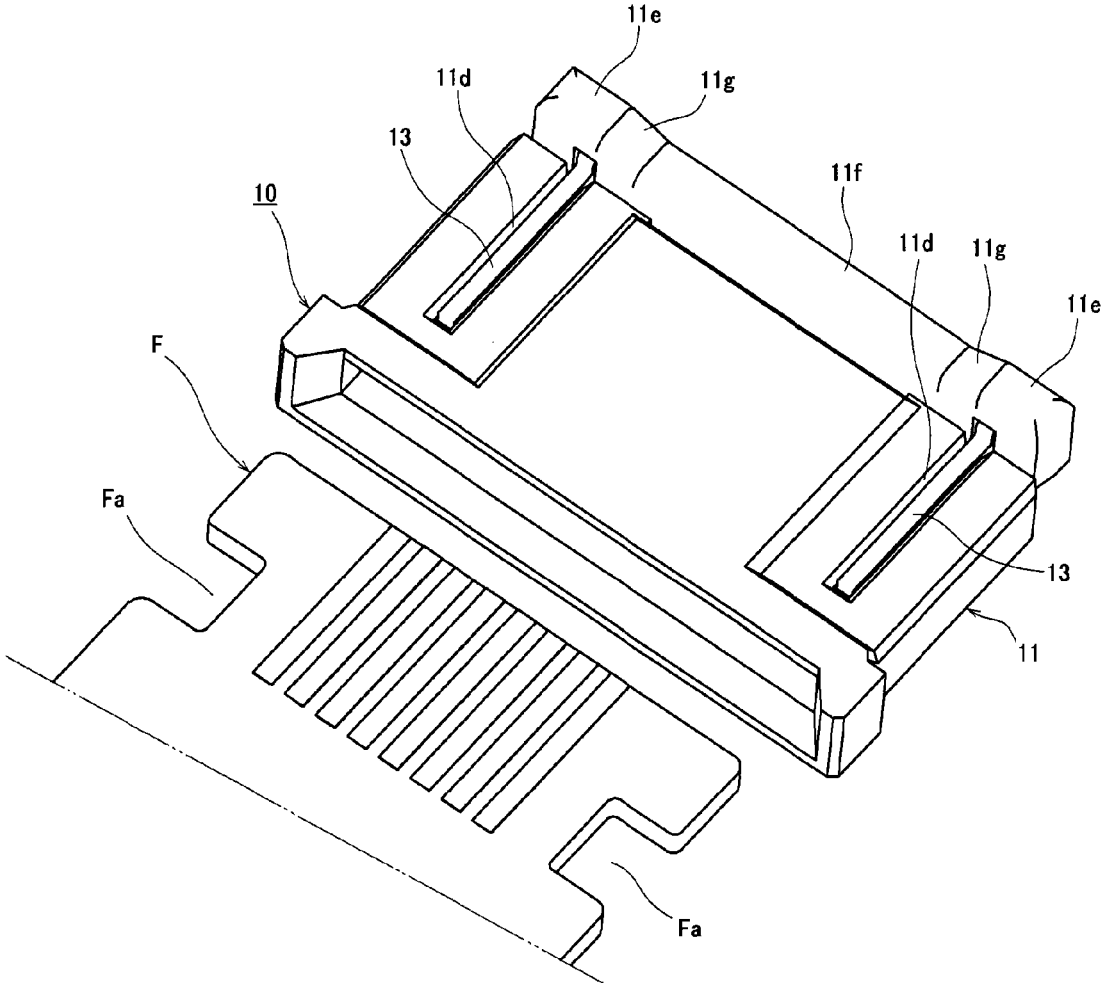
FIG. 12 is a descriptive external perspective view depicting the state immediately before the state in which the signal transmission medium is inserted in the electric connector depicted in FIG. 9 to FIG. 11.
Figure 13:
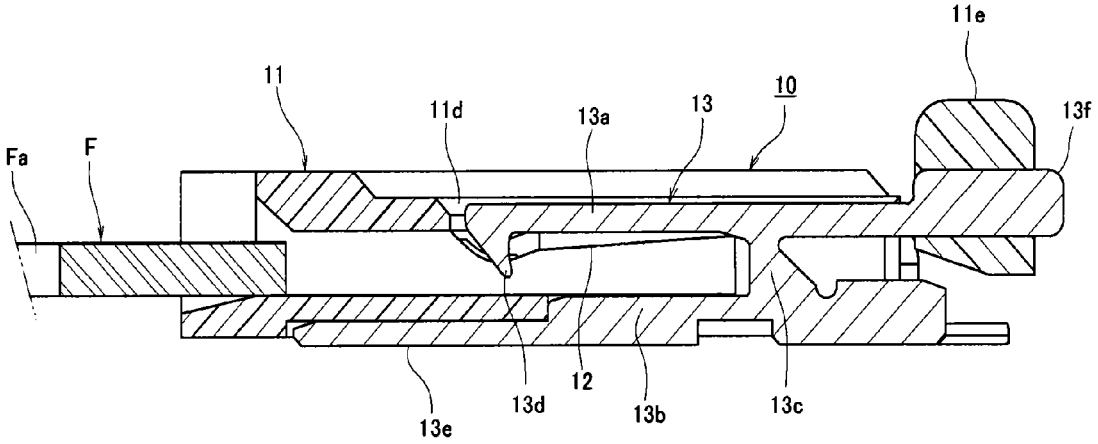
FIG. 13 a descriptive cross-sectional view corresponding to a XIII-XIII line in FIG. 10, depicting the state in which the signal transmission medium is partially inserted, the state being changed from the state depicted in FIG. 12.
Figure 14:
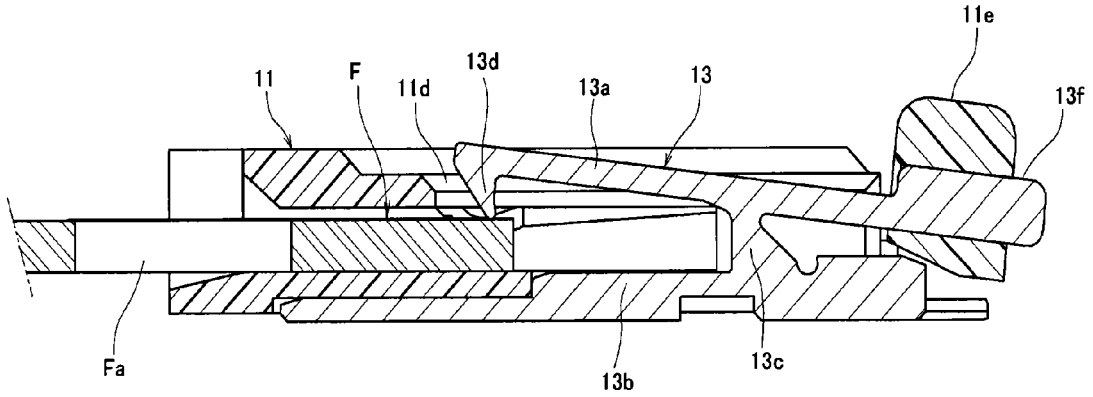
FIG. 14 is a descriptive cross-sectional view corresponding to the XIII-XIII line in FIG. 10, depicting the state in which the signal transmission medium is further inserted, the state being changed from the state depicted in FIG. 13.
Figure 15:
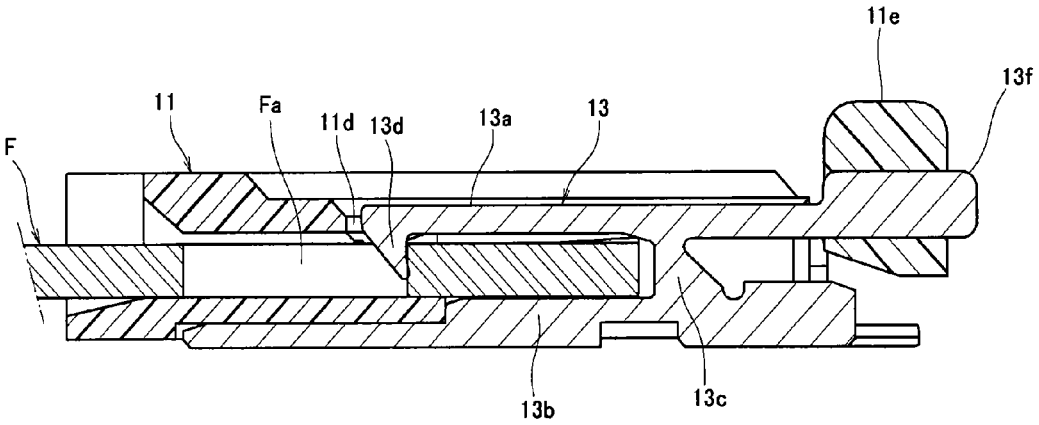
FIG. 15 is a descriptive cross-sectional view corresponding to the XIII-XIII line in FIG. 10, depicting the state in which the signal transmission medium is further inserted and thus insertion of the signal transmission medium in the electrical connector is completed, with the signal transmission medium being engaged by an engagement locking part, the state being changed from the state depicted in FIG. 14.
Figure 16:
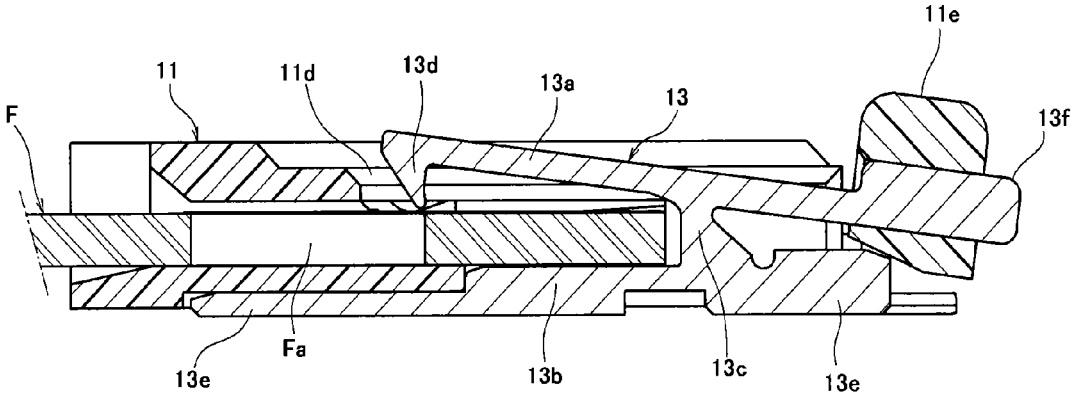
FIG. 16 is a descriptive cross-sectional view corresponding to the XIII-XIII line in FIG. 10, depicting the state in which a releasing operation is performed to push the lock member up, the state changed from a lock state depicted in FIG. 15.
Figure 17:
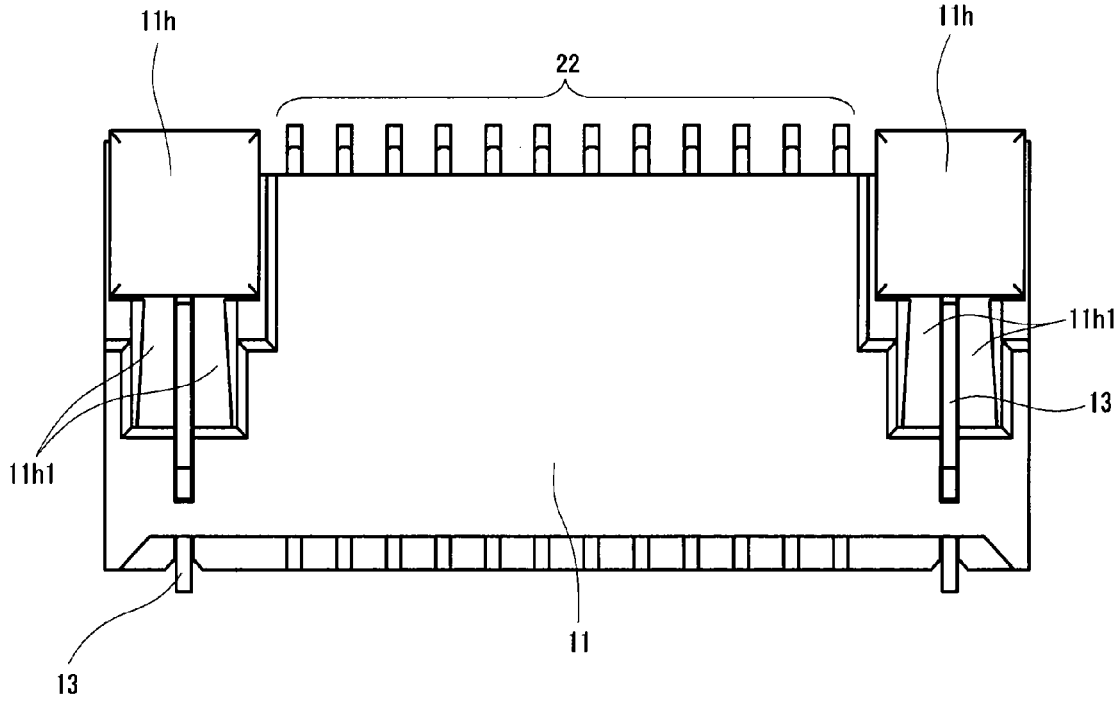
FIG. 17 is a descriptive plan view of an electric connector according to a third embodiment of the present, invention.
Figure 18:
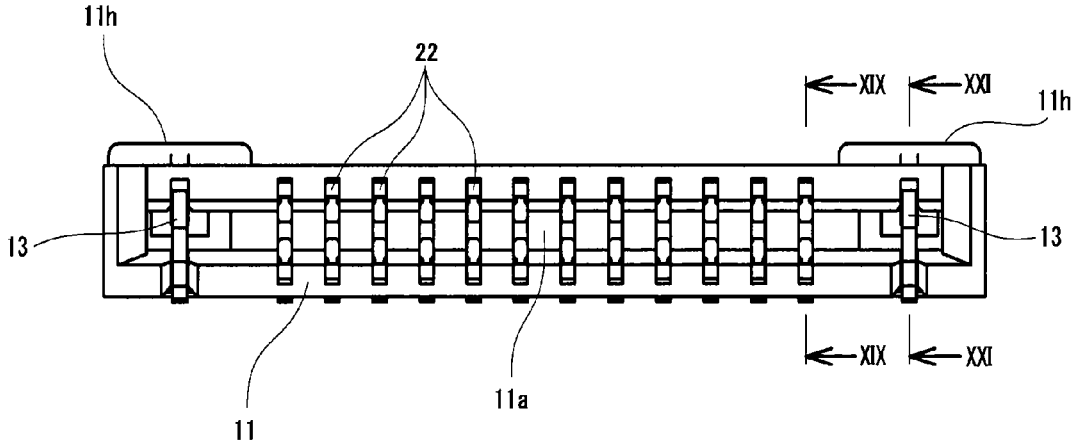
FIG. 18 is a descriptive front view of the electric connector depicted in FIG. 17.

On the other hand, when a lock releasing operation is is performed as depicted in FIG. 8 from the state in which each engagement lock part 13*d* is engaged with the engagement positioning part Fa of the signal transmission medium F to hold the signal transmission medium F, the engagement lock part 13*d* is swung so as to be lifted to an upper side against the elastic force of the movable beam part 13*a* of the lock member 13, thereby causing the engagement lock part 13*d* to be disengaged from the engaging positioning unit. Fa of the signal transmission medium F.

That is, in the movable beam part 13*a* of each lock member 13 described above, a portion opposite to the engagement locking part 13*d*, that is, a beam-shaped portion extending from the coupling support part 13*c* to a rear side, is provided with a lock release pressing part 13*f*. While this lock release pressing part 13*f* is configured to swing in a direction opposite to the engagement lock part 13*d* described above, the lock release pressing part 13*f* is formed so as to have a length protruding from a rear end part of the insulating housing 11 outward to a rear side. With the lock release pressing part 13*f* being pushed downward, the engagement lock part 13*d* on the front end side is pushed up to an upper side.

Also, correspondingly to this lock release pressing part 13*f*, paired lock operation cover portions 11*e* are provided on both end portions of the rear-end portion of the insulating housing 11 in the connector longitudinal direction. Each of these lock operation cover parts 11*e* is disposed so as to have a relation in which it extends rearward from the rear-end part of the insulating housing 11 in a cantilever shape at a position straight above the lock release pressing part 13*f* of the lock member 13 described above to overlap the lock release pressing part 13*f*. Also, each of these lock operation cover parts 11*e* is formed of a plate-shaped member having a relatively wide width, and is disposed so as to have a relation in which the lock operation cover part 11*e* having a relatively wide width covers, from an upper side, an upper edge part of the lock release pressing part 13*f* having a narrow plate width.

On an upper surface of the lock operation cover part 11*e*, a non-slip part with asperities is formed. With the lock operation cover part 11*e* being pushed downward by fingertips of the operator or the like, the lock release pressing part 13*f* of the lock member 13 described above is also pushed downward, thereby causing the engagement lock part 13*d* provided on an opposite side of the movable beam part 13*a* to be pushed upward. As a result, the engagement lock part 13*d* that has been engaged so far with the engagement positioning part Fa of the signal transmission medium F is disengaged upward from the engagement positioning part Fa, thereby causing the signal transmission medium F to become in a free state, which device that the signal transmission medium F becomes in a state of being removable toward a front side. Here, when the lock operation cover part 11*e* is pushed clown, a lower end surface of the lock release pressing part 13*f* abuts on the upper end surface of the lock fixing part, 11*c*. With this, it is possible to suppress excessive upward elastic displacement of the movable beam parts 13*a* and prevent deformation and damage of the lock members 13.

When a lock releasing operation is performed on each of the lock members 13 in this manner, the front-side portion of the movable beam part 13*a* including the engagement lock part 13*d* is elastically displaced so as to be pushed upward, as described above. Here, as with the time of insertion of the signal transmission medium (such as FPC or FFC) F described above, elastic displacement on the upper side of the movable beam part 13*a* is allowed by the slit part 11*d* provided in the insulating housing 11 as the lock checking device. Also, the protruding portion on the upper side of the movable beam part 13*a* is configured to protrude upward through the slit part 11*d*. With the upper protruding portion of each movable beam part 13*a* being visually checked from outside, the displaced state of the lock member 13 can be easily checked.

According to the present embodiment with the above-described structure, the upward displaced state of each lock member 13 when the signal transmission medium (such as FPC or FFC) is inserted up to the predetermined position is visually checked with ease from outside through the slit part 11*d* provided as lock checking device. Therefore, the quality of the insertion state of the signal transmission medium can be immediately checked and determined. In particular, in the present embodiment, a part of each lock member 13 through the slit part 11*b* is configured to protrude outside of the insulating housing 11. Therefore, the displaced state of each lock member 13 is visually checked excellently.

Furthermore, in the present embodiment, the lock operation cover part 11*e* overlapping the lock release pressing part 13*f* of each lock member 13 is provided in the insulating housing 11. Therefore, the operation of releasing the engaged state of the lock member 13 with respect to the signal transmission medium (such as FPC or FFC) is easily and reliably performed with an operation on the lock operation cover parts 11*e* of the insulating housing 11.

Regarding Electric Connector According to Second Embodiment

By contrast, in a second embodiment depicted in FIG. 9 to FIG. 16 with same components provided with the same reference character as that of the first embodiment described above, an operation ganged arm part 11*f* is provided extending so as to integrally couple the lock operation cover parts 11*e* disposed in a pair in the insulating housing 11 and appropriately spaced apart from each other.

According to the present embodiment with the above-described structure, a pushing-down operation for releasing the engaged state of the lock members 13 provided in a pair is simultaneously and efficiently performed with one operation on one position of the operation ganged arm part 11*f*. Here, at the time of the pushing-down operation on the operation ganged arm part 11*f*, with a lower end surface of each lock operation cover part 11*e* abutting on an upper end surface of the board connecting part 13*e* provided on a rear end side of the lock member 13, it is possible to suppress excessive upward elastic displacement of the movable beams 13*a* and prevent deformation and damage of the lock members 13.

Also, with inclined parts 11*g* provided at both end parts of the operation ganged arm part 11*f* in a longitudinal direction, the operation ganged arm part 11*f* in the present embodiment is configured so that a height in a pressing direction is decreased from the both end portions in the longitudinal direction to a center portion.

According to the present embodiment with the above-described structure, when the operation ganged arm part 11*f* is operated, fingertips of the operator are difficult to hook over the inclined surface parts 11*g* provided on both end sides of the operation ganged arm part 11*f*, and an operating force is added mainly to the center portion of the operation ganged arm part 11*f*, thereby making it possible to prevent damage and others on the operation ganged arm part 11*f*.

Regarding Electric Connector According to Third Embodiment

Further, in a third embodiment depicted in FIG. 17 to FIG. 24 with same components provided with the same reference character as that of the first embodiment described above, paired lock operation cover portions 11*h*, 11*h* are provided on both end portions of the rear-end portion of the insulating housing 11 in the connector longitudinal direction corresponding to the lock release pressing part 13*f* of the lock member 13 described above. Each of these lock operation cover parts 11*h* is integrally coupled to a tip portion of an elastic cover arm 11*h*1 on an extending side which extends rearward from the front part of the insulating housing 11 in a cantilever shape and has a relation in which it is disposed to overlap with the lock member 13 at a position straight above the lock release pressing part 13*f*.

Each of these paired lock operation cover parts 11*h* is formed of a planar substantially rectangular shaped member having a relatively wide width, and is disposed so as to have a relation in which the lock operation cover part 11*h* having a relatively wide width covers, from an upper side, an upper edge part of the lock release pressing part 13*f* having a narrow plate width provided on a rear end side of the lock member 13. Also, the elastic cover arm 11*h*1, which supports each of the lock operation cover parts 11*h* elastically in the upward and downward direction, is provided on a pair in each of the lock operation cover parts 11*h*. The pair of these elastic cover arm 11*h*1, 11*h*1 are disposed so as to sandwich each of the movable beam part 13*a* of the lock member 13 from both sides.

Also, a rear-end-side portion (a right-end-side portions in FIG. 21) of the lock operation cover parts 11*h* described above are formed to go and round under the lock member 13 so as to have a relation in which it covers the rear-end-side portion of the lock release pressing part 13*f* from the lower side. That is, the lock operation cover parts 11*h* in this embodiment has a lower cover supporting portion 11*h*2 which overlaps with the lock release pressing part 13*f* of the lock member 13 at a position straight below the lock release pressing part 13*f* so as to be configured that the lock operation cover parts 11*h* sandwiches the lock release pressing part 13*f* from the forward and backward (upward and downward) in which direction an operating down force is added so as to make the lock member 13 displace elastically. The entire of the lock operation cover parts 11*h* including the lower cover supporting portion 11*h*2 is configured to displace elastically in one piece with the lock member 13, and the entire parts of the lock member 13 and the lock operation cover parts 11*h* is supported by an elastic force from the pair of elastic cover arm 11*h*1, 11*h*1 described above.

As described above, in the present embodiment, according to the structure in which the lock operation cover parts 11*h* has the lower cover supporting portion 11*h*2 and the entire part of the lock member 13 and the lock operation cover parts 11*h* is supported elastically with the paired elastic cover arms 11*h*1, 11*h*1 for example, even when plastic deformation is caused in the lock member 13 by such as adding the lock releasing operation force, elastic holding force by the elastic cover arms 11*h*1, 11*h*1 acts on the lock member 13 from the downward side so as to hold the lock member 13 via the lower cover supporting portion 11*h*2. This elastic holding force by the elastic cover arms 11*h*1, 11*h*1 makes possible for the lock member 13 to come back to the original position so as to result in that a normal lock action by engagement lock part 13*d* of the lock member 13 is maintained steadily.

[Regarding Conductive Contacts]

Figure 19:
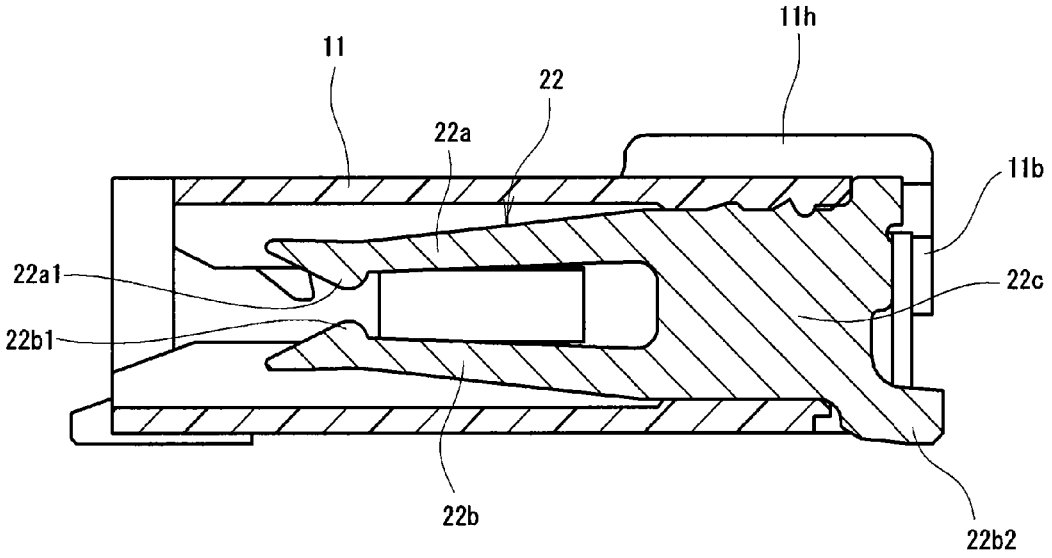
FIG. 19 is a descriptive cross-sectional view along a XIX-XIX line in FIG. 18.
Figure 20:
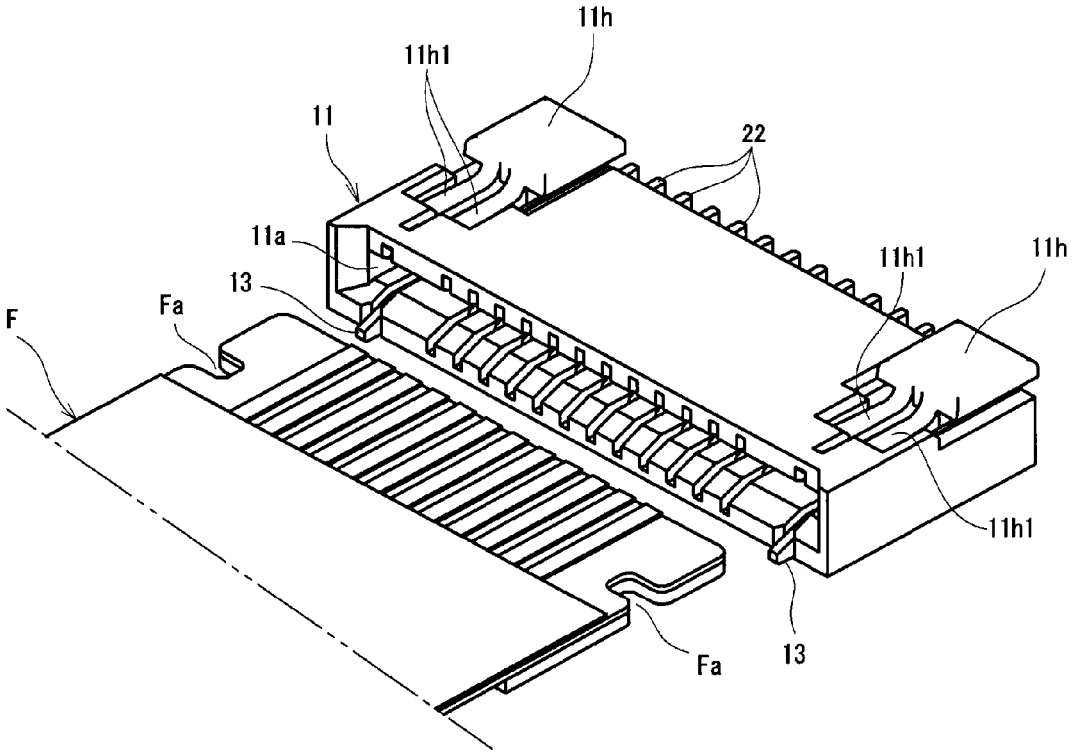
FIG. 20 is a descriptive external perspective view depicting the state immediately before the state in which the signal transmission medium is inserted in the electric connector depicted in FIG. 17 to FIG. 19.
Figure 21:
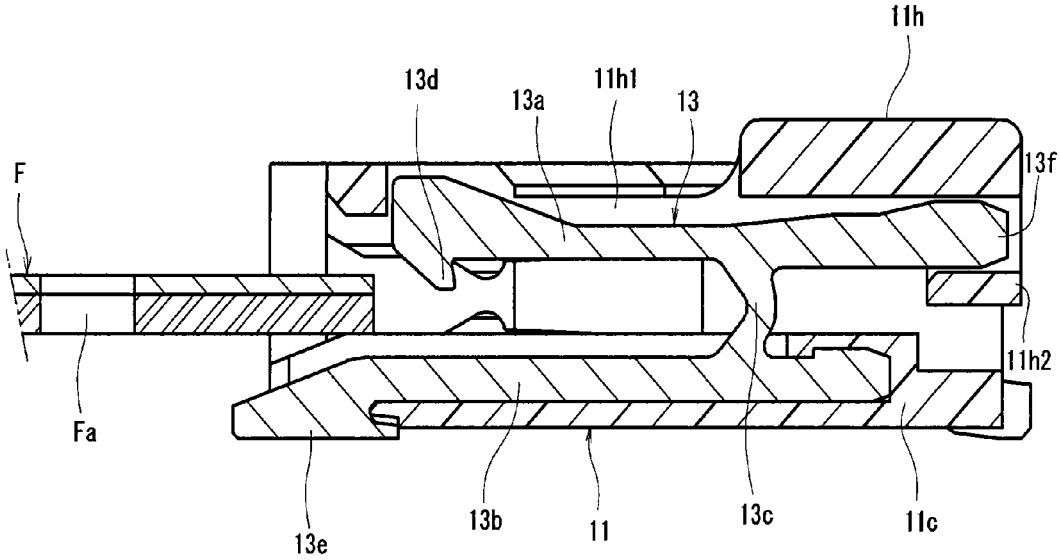
FIG. 21 a descriptive cross-sectional view corresponding to a XXI-XXI line in FIG. 18, depicting the state in which the signal transmission medium is partially inserted, the state being changed from the state depicted in FIG. 20.
Figure 22:
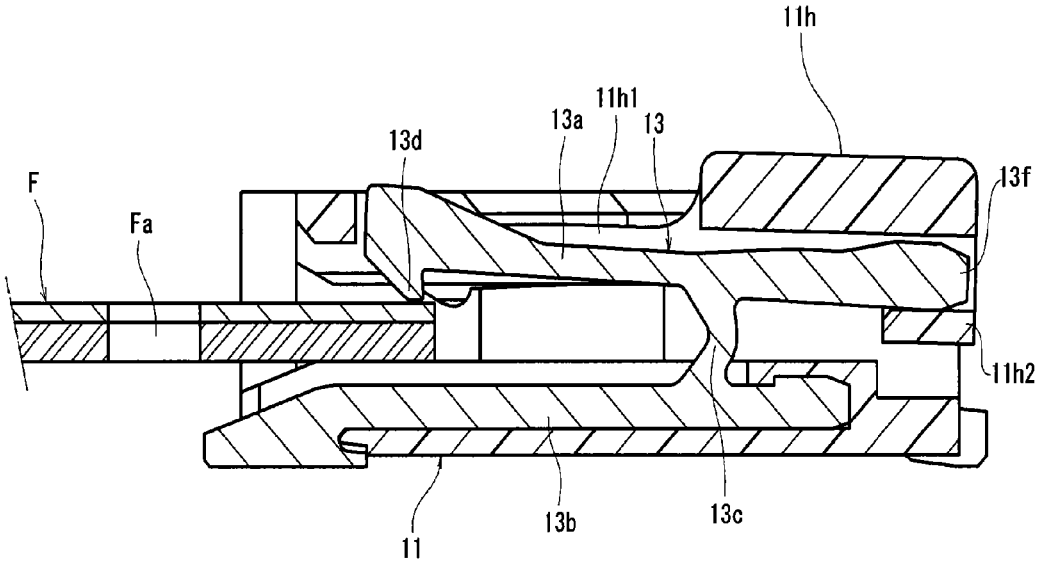
FIG. 22 is a descriptive cross-sectional view corresponding to the XXI-XXI line in FIG. 18, depicting the state in which the signal transmission medium is further inserted, the state being changed from the state depicted in FIG. 21.
Figure 23:
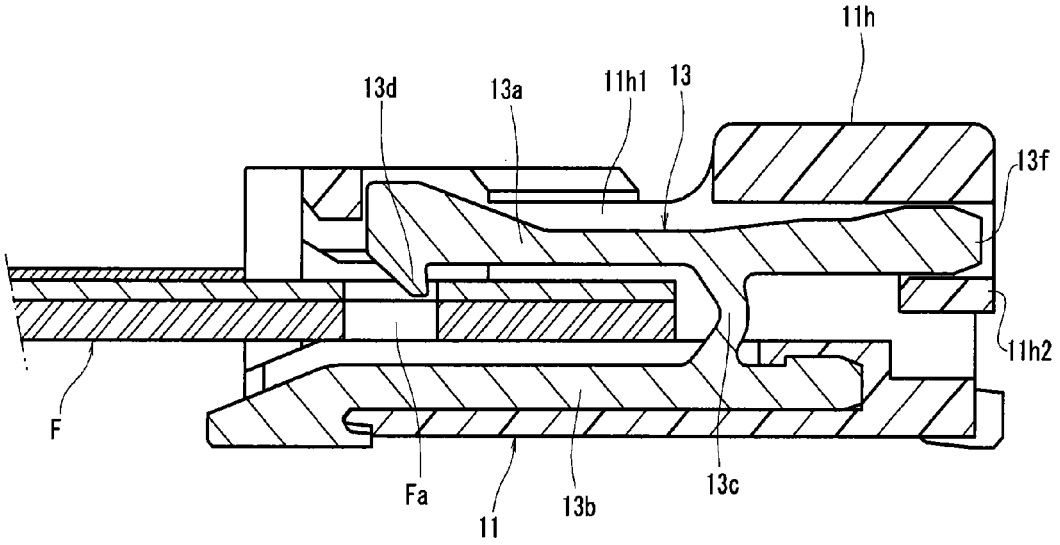
FIG. 23 is a descriptive cross-sectional view corresponding to the XXI-XXI line in FIG. 18, depicting the state in which the signal transmission medium is further inserted and thus insertion of the signal transmission medium in the electrical connector is completed, with the signal transmission medium being engaged by an engagement locking part, the state being changed from the state depicted in FIG. 22.
Figure 24:
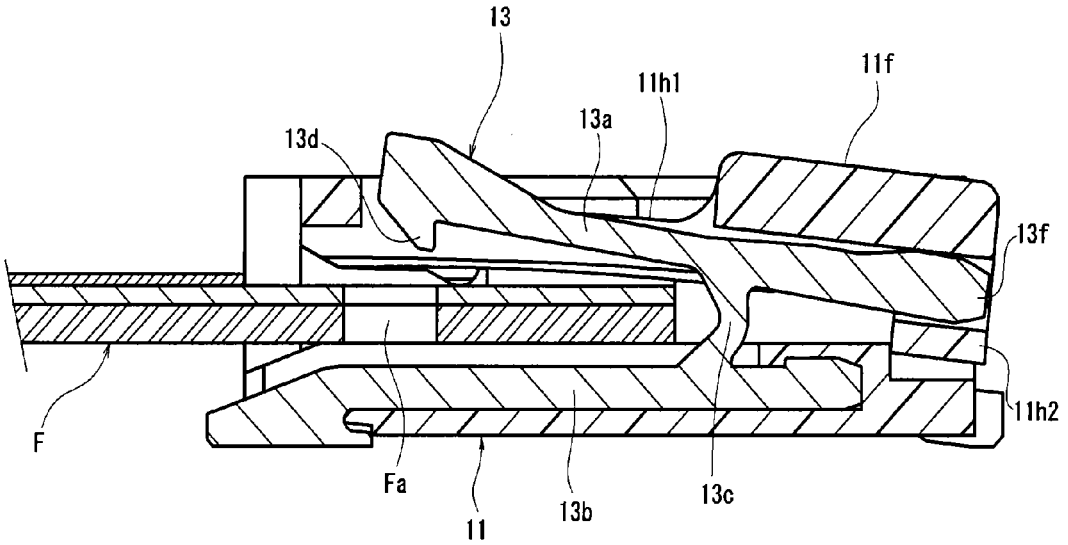
FIG. 24 is a descriptive cross-sectional view corresponding to the XIII-XIII line in FIG. 18, depicting the state in which a releasing operation is performed to push the lock member up, the state changed from a lock state depicted in FIG. 23.

Also, the conductive contacts 22 according to the present embodiment are mounted by being inserted from the component mount opening 11*b* provided on the connector rear end side of the insulating housing 11 toward a front side (a left side in FIG. 19). Each of these conductive contacts 22 mounted inside the insulating housing 11 as described above is disposed at a position corresponding to a wiring pattern of the signal transmission medium (such as FPC or FFC) F inserted inside of the insulating housing 11 via the medium insertion opening 11*a*. The wiring pattern formed on the signal transmission medium F is formed by disposing conductive paths for signal transmission (signal line pads) or conductive paths for shielding (shield line pads) with appropriate pitch spaces.

The conductive contacts 22 have a pair of a movable beam 22*a*, 22*b* respectively, each formed of an elongated beam member extending approximately in parallel along the front-back direction, which is an insertion/removal direction of the signal transmission medium F (a lateral direction in FIG. 19). These pairs of movable beams 22*a* and 22*b* are disposed so as to face each other as being appropriately spaced apart from each of her in an inner space of the insulating housing 11 described above in a vertical direction in the drawings. These movable beams 22*a* and 22*b* extending approximately in parallel are integrally coupled via coupling support parts 22*c* respectively. The front end portion of both of the movable beams 22*a* and 22*b* are formed so as to float from the inner wall surface of the insulating housing 11.

The coupling support part 22*c* is each formed of a plate-shaped member having a narrow width, and is disposed so as to extend in the vertical direction in the drawings in an approximately rear end portion in a direction in which both of the movable beams 22*a* and 22*b* extend. The movable beams 22*a* and 22*b* coupled to upper and lower end portions in the drawing of the coupling support parts 22*c*, respectively, are configured to be able to be elastically displaced, respectively, based on elastic flexibility of themselves and the coupling support parts 22*c*. The movable beams 22*a* and 22*b* are configured to be able to swing by taking the coupling support parts 22*c* or nearby as a rotation center. Here, the swinging of the movable beams 22*a* and 22*b* is performed in a vertical direction on paper in FIG. 19.

Further, front-end-side portions (left-end-side portions in FIG. 19) of the upper-side movable beams 22*a* are provided with upper terminal contact convex portions 22*a*1, respectively, to be connected to any wiring pattern (conductive path for signal transmission or for shielding) formed on an upper side of the signal transmission medium (such as FPC or FFC) F in the drawings so as to form a downward projected shape in the drawings, and front-side portions (a left-side portion in FIG. 19) of the lower-side beams 22*b* are provided with lower terminal contact convex parts 22*b*1, respectively, to be connected to the wiring pattern (conductive path for signal transmission or for shielding) formed on a lower side of the signal transmission medium (such as FPC or FFC) F in the drawings so as to form an upward projected shape in the drawings. These lower end contact convex parts 22*b*1 are disposed so as to face positions straight below the upper terminal contact convex parts 22*a*1 on the upper-side movable beams 22*a*, respectively, in the drawings. Between these upper and lower terminal contact convex parts 22*a*1 and upper and lower terminal contact convex parts 22*b*1, the signal transmission medium F is pinched.

Note that these upper and lower terminal contact convex parts 22*a*1 and 22*b*1 of the movable beam 22*a* and 22*b* can be disposed so as to be shifted in position to a connector front side (a left side in FIG. 19) or a connector rear side (a right side in FIG. 19).

Furthermore, a rear-end-side portion (a right-end-side portions in FIG. 19) of the lower-side beam 22*b* described above are provided with board connecting parts 22*b*2, respectively, to be connected by solder to a conductive path formed on the main wiring board.

While the invention made by the inventor has been specifically described based on the embodiments, the present invention is not meant to be restricted to the embodiments described above, and it goes without saying that the present invention can be variously modified within a range not deviating from the gist of the invention.

For example, the lock checking device can be formed as a window part, provided so as to penetrate through the wall surface of the insulating housing 11. Here, the window part as the lock checking device is provided so as to face a position inside the insulating housing 11 either before or after the lock member is displaced or a position therein either before or after the lock member is engaged to allow visual check.

Also, in each of the embodiments described above, while a flexible printed circuit (FPC) or a flexible flat cable (FFC) is adopted as a signal transmission medium to be fixed to the electric connector, the present invention can be similarly applied to the case in which another medium for signal transmission or the like is used.

Furthermore, while the conductive contacts having the same shape are used in the electric connector according to the embodiments described above, the present invention can be similarly applied even when the structure is such that conductive contacts having different shapes are alternately disposed.

The present invention can be widely applied to various types of electric connectors for use in various electric apparatuses.

What is claimed is:

1. An electric connector comprising:

an insulating housing; and a lock member provided inside the insulating housing and holding, in an approximately unmovable state, a terminal portion of a signal transmission medium inserted in the insulating housing up to a predetermined position, the electric connector being configured so that, after a part of the lock member is elastically displaced so as to override the surface of the signal transmission medium with the insertion of the signal transmission medium, the part of the lock member falls in an engagement positioning part provided at the terminal portion of the signal transmission medium to become in an engaged state, wherein the insulating housing is provided with lock checking device allowing a displaced state or an engaged state of the lock member to be visually checked, wherein the lock member is provided with a lock release pressing part to which an operating forces is added in a direction of elastically displacing the lock member, the insulating housing is provided with a lock operation cover part extending so as to overlapping the lock release pressing part of the lock member, and the lock operation cover part is configured that the lock operation cover parts sandwiches the lock release pressing part from the forward and backward in the direction in which an operating down force is added so as to make the lock member displace elastically.

2. The electric connector according to claim 1, wherein the lock checking device is configured of a window part or a slit part provided so as to penetrate through a wall surface configuring the insulating housing.

3. The electric connector according to claim 2, wherein the slit part as the lock checking device is configured so that the part of the lock member protrudes through the slit part toward outside of the insulating housing when the lock member is elastically displaced.

4. The electric connector according to claim 2, wherein the window part as the lock checking device is provided so as to face a position inside the insulating housing before or after displacement or before or after engagement of the lock member.

5. The electric connector according to claim 1, wherein the lock operation cover parts are disposed in a pair so as to be appropriately spaced apart from each other, and an operation ganged arm part is provided to extend so as to integrally couple the paired lock operation cover parts together.

6. The electric connector according to claim 5, wherein the operation ganged arm part is provided with inclined parts so that a height in a pressing direction is successively decreased from portions on both end sides to a center portion of the operation ganged arm part in a longitudinal direction.

* * * * *